United States Patent [19]

Tietze

[11] Patent Number: 4,719,763

[45] Date of Patent: Jan. 19, 1988

[54] DEVICE FOR CHANGING THE TEMPERATURE OF A ROOM

[76] Inventor: Hellmut Tietze, 6 Roslagsgatan, S-113 55 Stockholm, Sweden

[21] Appl. No.: 940,760

[22] PCT Filed: Mar. 13, 1986

[86] PCT No.: PCT/SE86/00108

§ 371 Date: Nov. 13, 1986

§ 102(e) Date: Nov. 13, 1986

[87] PCT Pub. No.: WO86/05572

PCT Pub. Date: Sep. 25, 1986

[30] Foreign Application Priority Data

Mar. 14, 1985 [SE] Sweden ..... 8501269

[51] Int. Cl.[4] ..... F25D 17/04

[52] U.S. Cl. ..... 62/186; 62/180; 62/201; 236/47; 236/91 R

[58] Field of Search ..... 62/186, 185, 180, 201, 62/231, 157, 278, 159, 196.4; 236/47, 91 R, 91 G

[56] References Cited

U.S. PATENT DOCUMENTS

| | | | |
|---|---|---|---|
| 2,153,696 | 4/1939 | Philipp | 62/185 X |
| 2,193,839 | 3/1940 | Anderson | 62/201 X |
| 2,876,630 | 3/1959 | Boling | 62/278 X |
| 2,917,702 | 12/1959 | Steghart et al. | 236/91 G |
| 3,127,929 | 4/1964 | Ringquist | 62/159 X |
| 3,421,339 | 1/1969 | Volk et al. | 62/159 |
| 4,110,997 | 9/1978 | Klotz et al. | 62/278 X |
| 4,403,646 | 9/1983 | Fodera | 236/47 |
| 4,505,426 | 3/1985 | Rossi et al. | 236/47 |

*Primary Examiner*—Harry Tanner

*Attorney, Agent, or Firm*—Cushman, Darby & Cushman

[57] ABSTRACT

A device for changing the temperature in a room includes: a refrigerant circuit including a refrigerant compressor, a condenser and an evaporator for receiving condensed refrigerant from the condenser; a cooling circuit including a cold accumulator for containing a cooling liquid, a heat exchanger for receiving cooling liquid from the cold accumulator and a pump for circulating cooling liquid through the cooling circuit; the evaporator being received in the cold accumulator to generate and accumulate cold in the cooling liquid by absorbing heat from the cooling liquid; a fan arranged to circulate air in the room through the heat exchanger for cooling the air; a control system arranged to start operation of the fan and the cooling circuit in response to a person entering the room and to stop operation of the fan and the cooling circuit in response to a person leaving the room; and a timer arranged to stop operation of the operating refrigerating circuit when a predetermined amount of cold has been generated and accumulated in the cooling liquid and when, upon starting operation of the fan and the cooling circuit, a predetermined minor amount of cold has been generated and accumulated in the cooling liquid.

3 Claims, 4 Drawing Figures

DEVICE FOR CHANGING THE TEMPERATURE OF A ROOM

TECHNICAL FIELD

This invention relates to a device for changing the temperature of a room and more specifically to a control system for a device in which room air is passed through a heat exchanger for heat exchange with a cooling liquid, the cooling liquid being cooled by a refrigerant circuit.

STATE OF THE ART

Devices for circulating air through heat exchangers and consequently lowering the room temperature from 35°–30° C. to 25°–20° C. in hotels, restaurants and offices in hot (tropic) countries are known. Despite the fact that a number of such devices and apparatuses of different sizes and designs are available on the market at varying prices it is found that such a comfort is lacking in many places inspite of the fact that a present indoor temperature is greatly needed and desired.

The reasons for this are numerous. One reason may be that existing compressors and fans generate such noise that the devices will be disturbing, especially at night. Another reason is that the power consumption is so high that the mains in many cases does not stand these additional loads. Moreover, bulky designs can make the devices unsuitable e.g. for small hotel rooms.

Another reason is that the room temperature generated often can not be easily adjusted to get the desired comfort; the difference between outdoor temperature and room temperature can for instance be too great to be correctly adapted and pleasant to the body.

It is the object of this invention to eliminate the disadvantages now mentioned and others.

SUMMARY OF THE INVENTION

In general it can be said that the cooling system of the device contains matter in at least two different states of phase. The amount of matter in a certain state of phase can however be so small in a borderline case the the cooling system of the device operates in practice with matter in one phase only, e.g. liquid phase.

The different states of phase can be liquid phase and solid phase or liquid and gas phase or else a combination of liquid phase/solid phase and liquid phase/gas phase.

In order to simplify in the following the detail description given under the heading PREFERRED EMBODIMENT a device with a cooling system containing a medium in liquid phase and solid phase is described there.

With such a design of the cooling system of the device that a portion of a circulating liquid is converted into ice in the refrigerant accumulator of the device the capacity is increased and the dimension reduced, and by such a way of function that the refrigerant accumulation substantially takes place during the day in hotel rooms and at night in office rooms it is possible to eliminate disturbing noise almost completely when the rooms are utilized. By having the device working so that the room air is cooled down for a substantially less part of the day than the part of the day during which the required cold is generated and accumulated the power consumption of the device is further substantially reduced.

BRIEF DESCRIPTION OF DRAWINGS

The invention will be described in greater detail in connection with the enclosed drawing where.

PREFERRED EMBODIMENT

Figure 1:
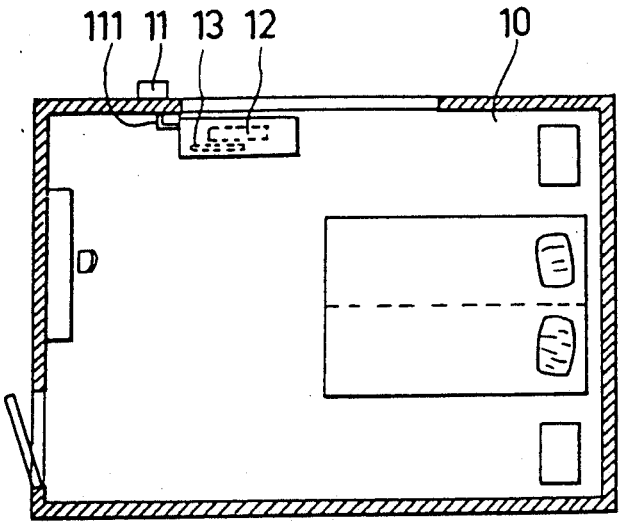
FIG. 1 shows schematically a hotel room with built-in device according to the invention and FIG. 2 shows schematically an electric circuit diagram for controlling the device of FIG. 1.

In FIG. 1 a hotel room 10 is shown where a device 11-12-13 according to the invention is installed. The device comprises a refrigerant generator 11-12, the compressor part of which is placed on the outside of the room 10. A pipe system 111 for circulating liquid (e.g. NaCl or KOH) leads the liquid to/from a refrigerant accumulator 12 within the room. The air of the room is circulated by a means 13, e.g. a fan, past the cold accumulator where, thus, the temperature of the air is lowered. The different parts of the device are so dimensioned and arranged that in the daytime when the room usually is empty and the consumption of current in the hotel normally is low the refrigerant generator 11-12 is operating and converts 50–80% of the liquid into ice in the refrigerant accumulator.

When about 65% of the liquid has been converted into solid form the compressor part 11 of the refrigerant generator is disconnected which normally takes place towards the afternoon. When a hotel guest unlocks the door to the room later, the means (fan) 13 for circulation of the air of the room through the accumulator 12 is started automatically. The cooling effect of this is thus maximum when most needed and the guest will notice immediately a pleasant temperature fall. The power consumption in the fan 13 is very small (30–40 W), and therefore the sound produced by it is not disturbing. When the guest leaves the room the fan 13 is automatically disconnected when the door is locked. Disconnection also takes place when the mean temperature of the room is lowered to a predetermined temperature, e.g. 25° C. at an outdoor temperature of 30° C., 27° C. at an outdoor temperature of 35° C. etc.

The temperature characteristic of the device is thus programmed into its electric connection part, but if the guest should desire a lower temperature it is possible to adjust it manually by a hand wheel on the front side of the device.

The capacity of the accumulator is so selected that the room temperature can be maintained at a desired value for about 12 hours. After this time the refrigerant generator will start again automatically even if the guest should be present in the room.

Figure 2:
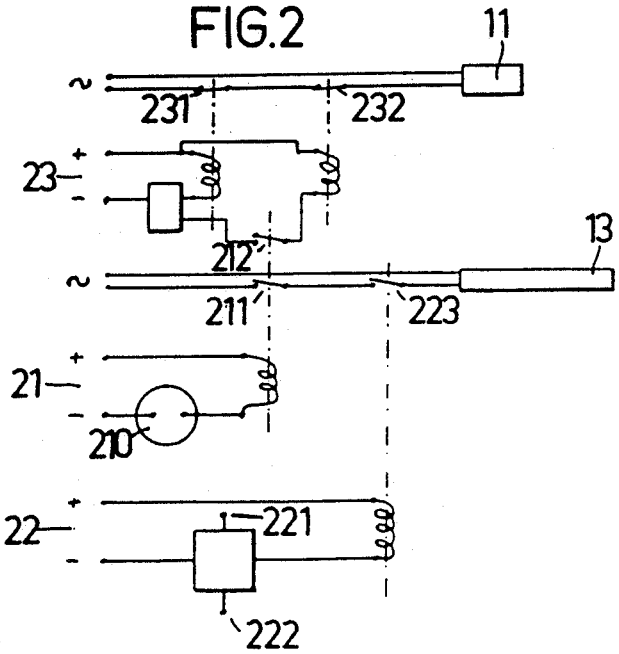

In FIG. 2 the compressor part 11 of the refrigerant generator and the fan 13 are shown, as well as a relay 21, a sensor 22 and a timer 23 for control of compressor and fan.

The timer 23 is arranged to disconnect the compressor 11 from the mains when some part of the cooling liquid has been converted into ice, for example 65%, which normally takes place after about 8 hours. A relay in the timer 23 will then cut out a contact 231 in the feeding branch to the compressor 11.

The relay 21 has a make contact 211 in the feeding branch to the fan 13. The relay is energized when a contact 210 is closed, for instance when a hotel guest unlocks the door lock of the room 10.

However, feeding to fan 13 is also actuated by a contact 223 in the sensor 22 having a signal input 221 from a transducer for the air temperature outside the room 10 and a signal input 222 from a transducer for the air temperature in the room 10. Thus, the sensor senses the difference in air temperature outdoors and indoors and cuts off and closes the feeding coil to the fan 13 when said difference amounts to pre-determined values. Thus, the device can be programmed, which has been indicated earlier, so that the room temperature, even the whole room atmosphere, is felt as pleasant which need not always mean a certain constant temperature at for example 22° C.

If the hotel guest should return to the room rather early after the refrigerant generator being started the accumulator 12 is perhaps not ready to take over the decrease of the room temperature. In that case the refrigerant generator need not be disconnected, and this does not take place, either, via the contact 231 of the relay 23. On the other hand, if the device has been connected for a not inessential time period, e.g. 3–4 hours, the cooling effect in the accumulator 12 is sufficient in order that the compressor part of the refrigerant generator might be shut off and consequently the major portion of the noise be eliminated. For this case the timer 23 has a second relay with cut-off contact 232. This relay is activated provided the relay 21 1has been energized and consequently closed the contact 212. When the guest leaves the room again the relay 21 switches off and consequently the second relay of the timer 23, i.e. the compressor will be connected again for continued storage of refrigerant in the accumulator 12.

The invention is not restricted to the device now described as an example. It can be modified in several ways and be provided with different supplements without violating the scope of the inventive idea. It can for instance be suitable to provide the device with an electrostatic filter on its output side for cleaning the circulating air from insects, dust, smoke etc. Moreover, it can be desirable to arrange in connection with the refrigerant accumulator a separate cooling space (refrigerator) for cooling drinking-water, mineral waters etc. For countires with great variations in day temperature it may perhaps be suitable to supplement the device with an immersion heater replacing the refrigerant generator in cold periods.

Figure 3:
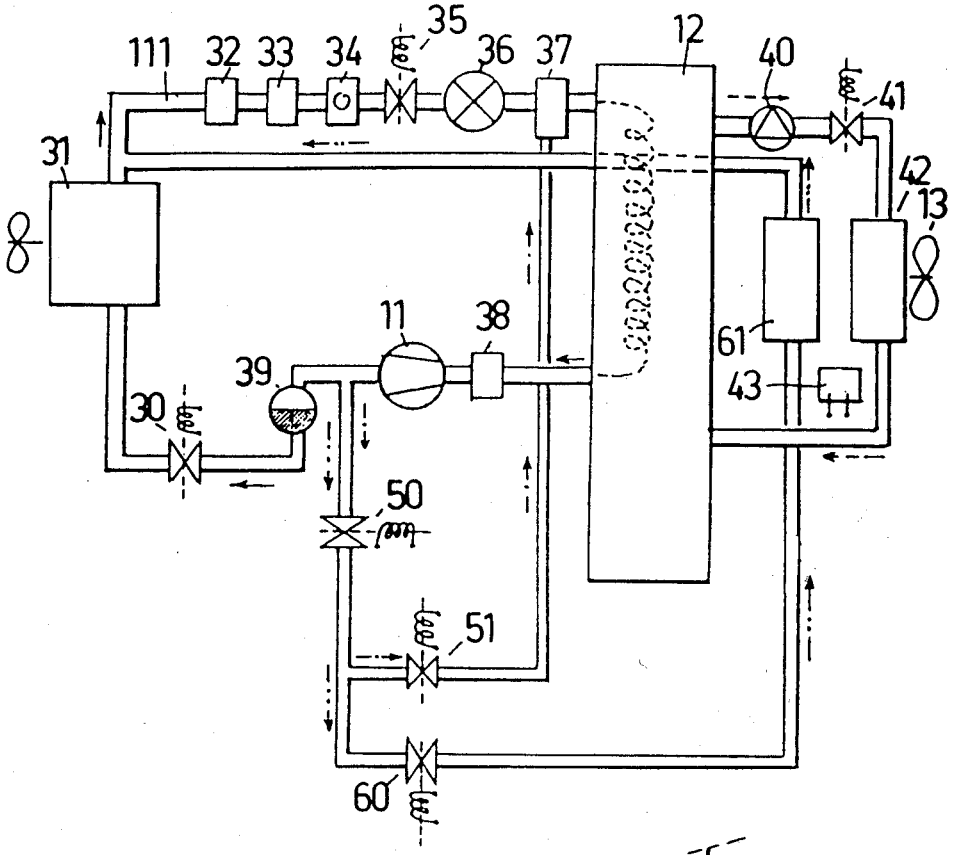
FIG. 3 is a more detailed view of the refrigerant circuit and cooling circuit of FIG. 1.
Figure 4:
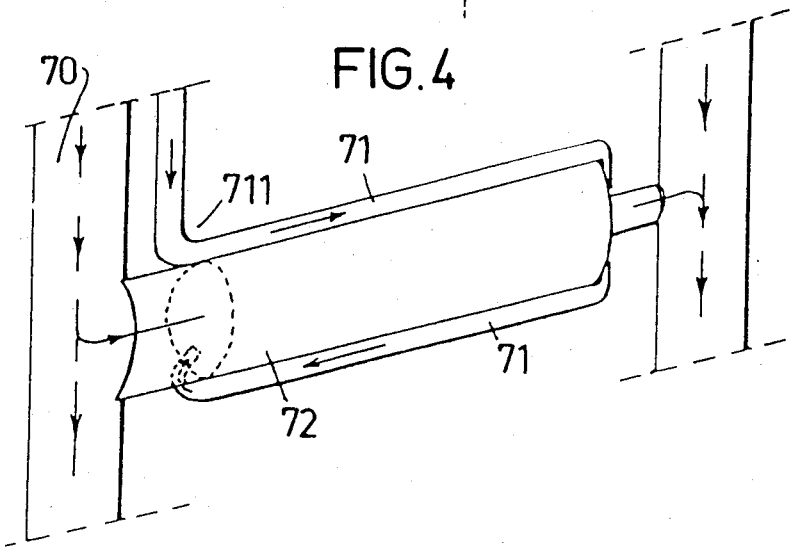
FIG. 4 is a fragmentary view, on an enlarged scale, of part of FIG. 3.

Details of a suitable system are described in FIGS. 3–4, viz through its four different processes cold generation, process of ice breaking up, cold emission and heat emission.

Refrigerant generation

The compressor 11 will suck gas from the cold accumulator 12 and compress it to liquid which is led to a container 39 for refrigerant. A magnet valve 30 is open and leads the liquid to the air-cooled condenser 31 located outside the room 10 and provided with a fan. After cooling the liquid is led via pressure equalizer 32, drying filter 33, inspection means 34 and an open magnet valve 35 to the expansion valve 36 and evaporator in the tank (cold accumulator) 12, where cold is generated and stored in a mixture of water and ice.

The gas is led further to pressure equalizer 38 and compressor 11 after which the process continues as described. Thus, in this function the valves 30 and 35 are open while the valves 50, 51, 60 and 41 are closed.

Process of ice breaking up

In order to render the cooling process more effective a special process of breaking up ice is arranged meaning that ice formed to a certain thickness on relatively coarse pipes in the vapourizer in the refrigerant accumulator 12 is caused to come off the pipes and mix with the water of the tank. In this way a more rapid ice formation with less energy consumption and consequently lower costs is obtained.

When after ice formation for about 3–4 minutes an ice layer of about 3–6 mm has been created on the pipe 72 of the evaporator, see FIG. 4, the following takes place: The magnet valves 50 and 51 are opened. Liquid is then led to the input side of the evaporator, more specifically to a special defrosting line 71 of a relatively small dimension lying close to the upper and lower side of the thicker pipes 72, see FIG. 4 showing a section of a large pipe 72 and a small defrosting line 71. The relatively hot gas enters at 711 and is then led along the upper side and lower side of the pipe 71 into the pipe 72 and further to the output side of the evaporator and the compressor 11. The evaporator contains a number of parallel large pipes 72 and defrosting lines 71 lie along the upper and lower sides of all the pipes 72. After about 30–60 seconds the ice has come off from the pipes 72 and the valves 50, 51 are closed, the valve 30 is opened and the refrigerant generation can start immediately.

Refrigerant emission

When a guest enters the room 10 and hangs his room key on an intended place, a contact being activated, the valve 41 is opened and a pump 40 and the fan 13 start, cold liquid circulating through a heat exchanger or cooling coil 42 and the fan circulating air cooled by the battery through the room 10. This gives immediately the guest in the room a pleasant feeling without any disturbing noise as the pump 40 is relatively small. When the guest leaves the room 10 and takes the key from the place where it is hanging, the pump 40 and the valve 41 will close, the function of the evaporator now merely being utilized for producing ice in the tank 12. Conditions for the above-mentioned cold emission to the room 10 are on one hand that the evaporator has had time to generate a certain amount of ice in the tank 12 and, on the other hand, that the temperature of the room exceeds a certain predetermined value as previously indicated in the general description. For adjustment of the temperature there is a thermostat 43 which, thus, controls the connection of the pump 40 and the valve 41 together with the key function.

Heat emission

In case heat is desired instead of cold in the room the device operates in the following way. The valves 30, 41 and 51 are closed. The hot liquid from the compressor 11 is passing the open valves 50, 60 to a heat battery 61, the heat of which is spread to the room 10 through the fan 13. The cooled liquid is led to the expansion valve 36 and is then evaporated in the cooling process, as previously described. Thus, a simultaneous heating of the room and ice production in the tank 12 take place. The thermostate 43 is arranged to close the valve 60, open the valve 30 and stop the fan 13 when reaching a certain desired temperature in the room 10.

The contact mentioned in connection with a guest's room key in this modification can be the contact 210 according to FIG. 2.

For the sake of clearness no signal or control lines have been shown in FIG. 3. When it is known which functions the different objects such as valves, fans, batteries, etc. should have it is then quite natural how the control and connection are to be made. This—the control and connection—is carried out by means of a microprocessor with built-in clock and programmable step (circuit card) for adaptation to different times of the year and local climate conditions.

What is claimed:

1. A device for changing the temperature in a room, comprising a refrigerant circuit including refrigerant compressor means, condenser means for receiving compressed refrigerant from the compressor means, and an evaporator for receiving condensed refrigerant from the condenser means;

a cooling circuit including cold accumulator for containing cooling liquid, a heat exchanger for receiving cooling liquid from the cold accumulator and a pump for circulating cooling liquid through the cooling circuit;

said evaporator being received in the cold accumulator to generate and accumulate cold in the cooling liquid by absorbing heat from the cooling liquid; and fan means arranged to circulate air in the room through said heat exchanger for cooling the air, the improvement comprising:

control means arranged to start operation of the fan means and the cooling circuit in response to a person entering the room and to stop operation of the fan means and the cooling circuit in response to a person leaving the room;

timer means arranged to stop operation of the operating refrigerating circuit when a predetermined amount of cold has been generated and accumulated in the cooling liquid and when, upon starting operation of the fan means and the cooling circuit, a predetermined minor amount of cold has been generated and accumulated in the cooling liquid.

2. A device according to claim 1, inclduing sensor means for sensing a difference between the air temperature in the room and air temperature outside the room, and for starting operation of the fan means and the cooling circuit when said difference amounts to a predetermined lower value and to stop operation of the fan means and the cooling circuit when said difference amounts to a predetermined higher value.

3. A device according to claim 1, wherein said control means includes a switch arranged to start and stop operation of the fan means and the cooling circuit, the switch being actuated by a key upon locking and unlocking a door to said room.

* * * * *